US008302255B2

(12) United States Patent
Lin

(10) Patent No.: US 8,302,255 B2
(45) Date of Patent: Nov. 6, 2012

(54) HEXAGONAL WRENCH

(76) Inventor: Tsung-Ming Lin, Ta-Li (TW)

( * ) Notice: Subject to any disclaimer, the term of this patent is extended or adjusted under 35 U.S.C. 154(b) by 265 days.

(21) Appl. No.: 12/775,462

(22) Filed: May 6, 2010

(65) Prior Publication Data

US 2011/0271800 A1 Nov. 10, 2011

(51) Int. Cl.
*B25B 23/08* (2006.01)

(52) U.S. Cl. ..... 15/441; 15/436; 15/53.2

(58) Field of Classification Search ..... 81/441, 81/436, 53.2
See application file for complete search history.

(56) References Cited

U.S. PATENT DOCUMENTS

| | | | | |
|---|---|---|---|---|
| 2,121,197 | A * | 6/1938 | Jackman | 81/441 |
| 5,873,290 | A * | 2/1999 | Chaconas | 81/436 |
| 6,152,000 | A * | 11/2000 | Mowins | 81/441 |
| 7,044,034 | B2 * | 5/2006 | Hsien | 81/452 |
| 7,225,710 | B2 * | 6/2007 | Pacheco, Jr. | 81/460 |

* cited by examiner

*Primary Examiner* — Robert Scruggs
(74) *Attorney, Agent, or Firm* — Hershkovitz & Associates LLC

(57) ABSTRACT

A hexagonal wrench has a head. The head has an end surface, six equal side surfaces and at least one groove. Each side surface has a left edge segment and a right edge segment adjacent to the left edge segment of an adjacent side surface. The at least one groove is formed in at least one of the right edge segments and the left edge segments and extends to the end surface. Therefore, the head can engage securely an inner surface of a socket to rotate the socket even when the socket is worn or rounded.

4 Claims, 3 Drawing Sheets

HEXAGONAL WRENCH

BACKGROUND OF THE INVENTION

1. Field of the Invention

The present invention relates to a hexagonal wrench, and more particularly to a hexagonal wrench capable of engaging an inner surface of a socket securely.

2. Description of Related Art

A conventional hexagonal wrench has a head for insertion into a socket and rotating a socket head screw. However, an inner surface of the socket will be worn, enlarged and rounded due to frequent use. Consequently, the head slips in the socket and a relative rotation between the head of the conventional hexagonal wrench and the socket will easily happen during operation. This is inconvenient and ineffective in use.

To overcome the shortcomings, the present invention tends to provide a hexagonal wrench to mitigate the aforementioned problems.

SUMMARY OF THE INVENTION

The main objective of the invention is to provide a hexagonal wrench capable of engaging an inner surface of a socket head screw.

A hexagonal wrench has a head. The head has an end surface, six equal side surfaces and at least one groove. Each side surface has a left edge segment and a right edge segment adjacent to the left edge segment of an adjacent side surface. The at least one groove is formed in at least one of the right edge segments and the left edge segments and extends to the end surface. Therefore, the head can engage securely an inner surface of a socket to rotate the socket even when the socket is worn or rounded.

Other objects, advantages and novel features of the invention will become more apparent from the following detailed description when taken in conjunction with the accompanying drawings.

DETAILED DESCRIPTION OF PREFERRED EMBODIMENT

Figure 1:
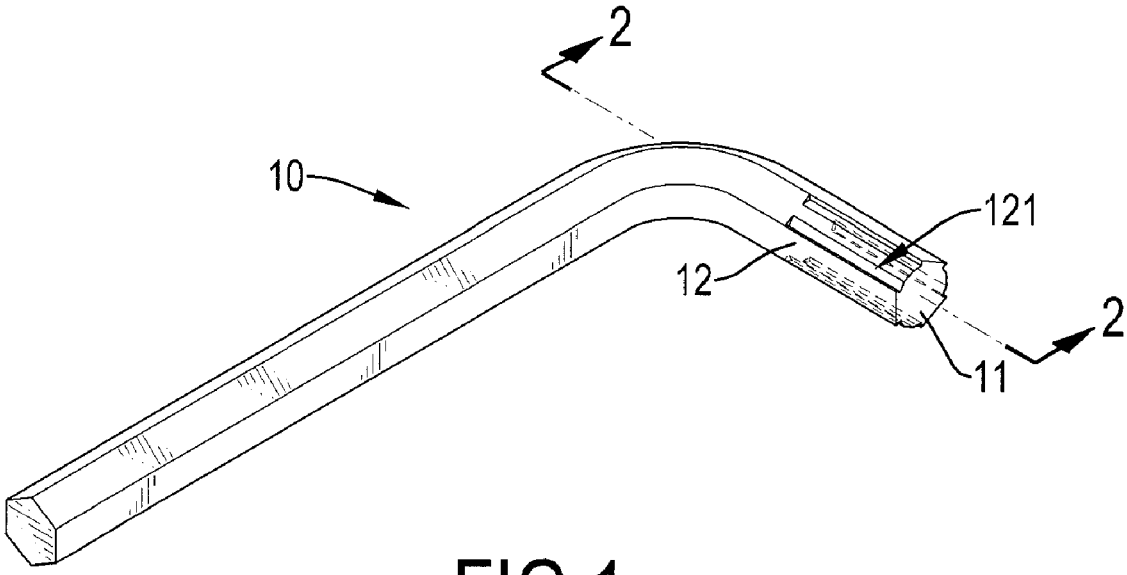
FIG. 1 is a perspective view of a first embodiment of a hexagonal wrench in accordance with the present invention.
Figure 2:
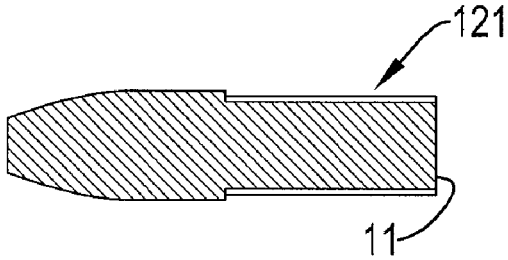
FIG. 2 is a cross sectional side view of the hexagonal wrench along line 2-2 in FIG. 1.
Figure 3:
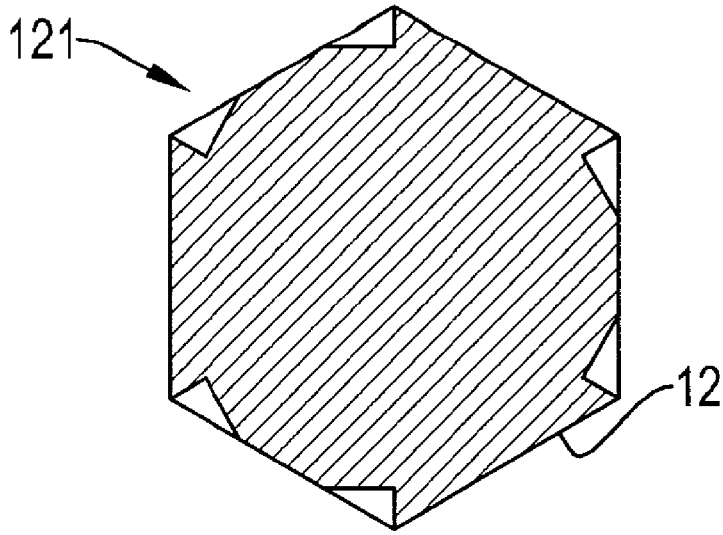
FIG. 3 is an enlarged cross-sectional end view of the hexagonal wrench in FIG. 1.
Figure 4:
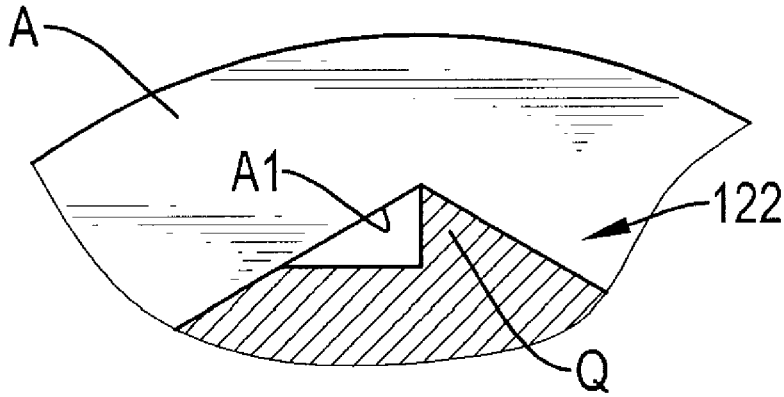
FIG. 4 is an enlarged operational end view in a partial section of the hexagonal wrench in FIG. 1, wherein the head of the hexagonal wrench is inserted into a socket head screw.

With reference to FIGS. 1 to 3, a first embodiment of a hexagonal wrench in accordance with the present invention is an L-shaped rod and comprises a head 10. The head 10 has a hexagonal cross section and is used for insertion into a socket A1 of a socket head screw A, as shown in FIG. 4. The head 10 has an end surface 11, six equal side surfaces 12 and at least one groove 121. The end surface 11 is flat. Each side surface 12 has a right edge segment 122 and a left edge segment 122. The right edge segment 122 of each side surface 12 is adjacent to the left edge segment 122 of the adjacent side surface 12. Accordingly, six corners Q are respectively formed by the right edge segments 122 and the left edge segments 122.

The at least one groove 121 is formed in at least one of the right edge segments and the left edge segments of the side surfaces 12 so as to make at least one of the corners Q become acute. The at least one groove 121 extends to the end surface.

In the first embodiment of the hexagonal wrench in accordance with the present invention, three of the side surfaces 12 that are arranged at intervals are categorized as a first unit. The other three of the side surfaces 12 are categorized as a second unit. Each side surface 12 of the first unit has two grooves 121 respectively formed in the right edge segment 122 and the left edge segment 122 of the side surface 12. Accordingly, six grooves 121 and six acute corners Q are implemented.

Each groove 121 is elongated along a direction which is parallel to an axis of the head 10. Preferably, each groove 121 has a triangular cross section.

With further reference to FIG. 4, the head 10 is inserted into the socket A1. If an inner surface of the socket A1 is worn and becomes enlarged or rounded after frequent use, the head 10 can be rotated clockwise or counterclockwise a little bit to make the acute corners Q engage securely the inner surface of the socket A1. Therefore, the head 10 can efficiently drive the socket A1 to rotate.

Because each side surface 12 of the first unit has two grooves 121, the head 10 is always capable of engaging the inner surface of the socket A1 of the socket head screw A securely whether the head 10 rotates clockwise or counterclockwise.

Figure 5:
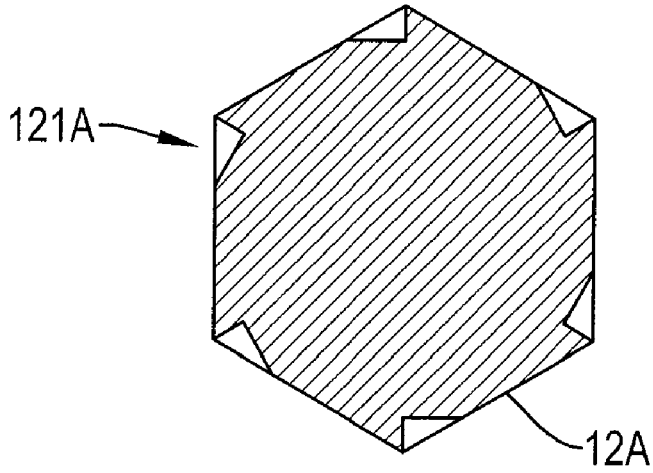
FIG. 5 is an enlarged cross-sectional end view of a second embodiment of the hexagonal wrench in accordance with the present invention.

With reference to FIG. 5, in a second embodiment of the hexagonal wrench in accordance with the present invention, each side surface 12A has a groove 121A formed in the right edge segment 122.

Figure 6:
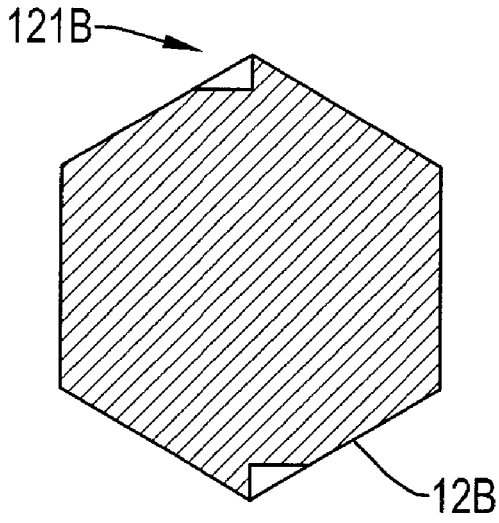
FIG. 6 is an enlarged cross-sectional end view of a third embodiment of the hexagonal wrench in accordance with the present invention.

With reference to FIG. 6, in a third embodiment of the hexagonal wrench in accordance with the present invention, two grooves 121B are implemented. The grooves 121B are respectively formed in the right edge segments 122 of two opposite side surfaces 12B.

Figure 7:
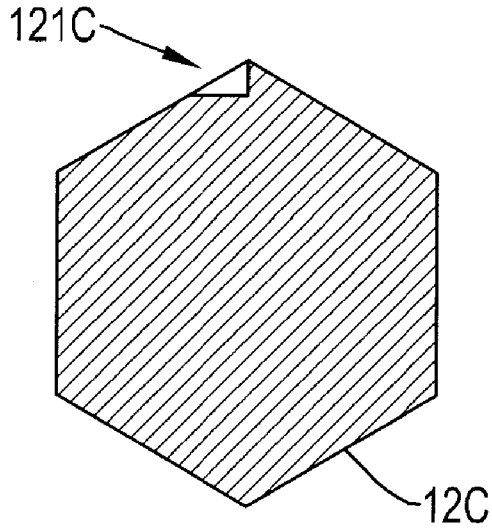
FIG. 7 is an enlarged cross-sectional end view of a fourth embodiment of the hexagonal wrench in accordance with the present invention.

With reference to FIG. 7, in a fourth embodiment of the hexagonal wrench in accordance with the present invention, a single groove 121C is implemented. And the groove 121C is formed in the right edge segment 122 of one of the side surfaces 12C.

As long as the head 10 can engage securely the inner surface of the socket A1, the present invention does not limit the number and the arrangement of the grooves 121,121A, 121B,121C.

From the above description, it is noted that the present invention has the advantage of that the head 10 can engage securely the inner surface of the socket A1 to rotate the socket A1 even when the socket A1 is worn or rounded.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hexagonal wrench comprising:

a head having an end surface;

six equal side surfaces, each having a left edge segment; and a right edge segment adjacent to the left edge segment of an adjacent side surface;

six corners, each corner formed by the left edge segment of one of the side surfaces and the right edge segment of a corresponding adjacent one of the side surfaces; and at least one groove formed in at least one of the right edge segments and the left edge segments of the side surfaces and extending to the end surface, wherein the at least one groove is respectively formed on at least one of the corners to make the at least one of the corners become acute-angled.

2. The hexagonal wrench as claimed in claim 1, wherein each side surface has a groove formed in the right edge segment of the side surface.

3. The hexagonal wrench as claimed in claim 1, wherein two grooves are implemented; and the grooves are respectively formed in the right edge segments of two opposite ones of the side surfaces.

4. A hexagonal wrench comprising:

a head having an end surface;

six equal side surfaces, each having a left edge segment; and a right edge segment adjacent to the left edge segment of an adjacent side surface; and at least one groove formed in at least one of the right edge segments and the left edge segments of the side surfaces and extending to the end surface, wherein three of the side surfaces that are arranged at intervals are categorized as a first unit; and each side surface of the first unit has two grooves respectively formed in the right edge segment and the left edge segment of the side surface.

* * * * *